US005916099A

United States Patent [19]

Hall

[11] Patent Number: 5,916,099

[45] Date of Patent: Jun. 29, 1999

[54] INTEGRAL CORNER WALL AND INSIDE STAIR STRUCTURE FOR A SWIMMING POOL

[76] Inventor: David E. Hall, 1529 46th Ave., Moline, Ill. 61265

[21] Appl. No.: 09/062,575

[22] Filed: Apr. 20, 1998

[51] Int. Cl.[6] ..... E04F 11/00; E04H 4/00

[52] U.S. Cl. ..... 52/169.7; 52/191; 52/182; 4/496

[58] Field of Search ..... 52/169.7, 182, 52/191; 4/496, 504, 506, 498

[56] References Cited

U.S. PATENT DOCUMENTS

| | | | |
|---|---|---|---|
| 3,374,491 | 3/1968 | Patin et al. | 52/169.7 X |
| 3,610,564 | 10/1971 | Mattingly | 52/169.7 X |
| 3,744,198 | 7/1973 | Boassy | 52/169.7 X |
| 3,755,981 | 9/1973 | West | 52/169.7 X |
| 3,848,378 | 11/1974 | Witte | 52/169.7 X |
| 4,589,237 | 5/1986 | Dahowski | 52/169.7 |
| 4,599,835 | 7/1986 | Rinke | 52/169.7 X |
| 4,628,646 | 12/1986 | Eyerle | 52/169.7 X |
| 5,644,873 | 7/1997 | Bourgault | 52/182 |
| 5,678,256 | 10/1997 | Lea | 52/182 X |

FOREIGN PATENT DOCUMENTS

| | | | |
|---|---|---|---|
| 2508-525 | 6/1981 | France | 52/169.7 |
| 3215-133-A | 10/1983 | Germany | 52/169.7 |
| 1571-794 | 7/1980 | United Kingdom | 52/169.7 |

*Primary Examiner*—Christopher Kent
*Assistant Examiner*—Brian E. Glessner
*Attorney, Agent, or Firm*—Glenn H. Antrim

[57] ABSTRACT

A corner stair and a corner wall of a pool are molded into an interal structure. A top step and riser are located at the required height to permit the lead bar of a swimming-pool automatic cover to be positioned over the step and against the riser such that the cover is completely over the pool including the top of the stair. Only an operation of the automatic pool cover is required to prevent rubbish from entering the pool and to eliminate the danger of small children entering the pool unattended.

1 Claim, 3 Drawing Sheets

INTEGRAL CORNER WALL AND INSIDE STAIR STRUCTURE FOR A SWIMMING POOL

BACKGROUND OF THE INVENTION

This invention relates to stairs that extend inward and downward from the the inside uppered edge of a wall of a respective swimming pool to the bottom of the pool, and particularly to integral, molded stairs. The present stair that is entirely within the walls of a swimming pool is desirable in residential swimming pools such that an automatic pool cover will completely cover the stair when operated to protect children from danger and to keep out dust.

SUMMARY OF THE INVENTION

Previously, stairs have often extended outward rather than inward from walls of respective swimming pools. Therefore, an automatic pool cover when operated to cover the pool could not also cover the top of the stair that is outside the usual pool wall.

The present stair is a corner stair and has a wall portion extending from a corner at the middle of the upper riser of the stair for fastening to an adjacent usual prefabricated side panel of the pool and an opposite wall portion extending perpendicularly with respect to the side panel from the center of the the riser to be connected to an adjacent end panel of the pool. The stair is particularly suitable for residential pools having a plastic liner covering the bottom of the pool and the inside surface of the wall. The wall portions of the present corner stair are sealed to the adjacent panels and to the liner in a usual manner, and the riser that extends from the bottom of the pool to the lower step of the stair is sealed to the liner.

The riser of the top step that is a short distance below the coping along the top of the wall of the pool has an inside corner with sufficient space for the lead bar of an automatic cover to be positioned contingently along the end wall of the pool such that all the stair is covered for preventing access to the pool.

DESCRIPTION OF THE PREFERRED EMBODIMENT

Figure 1:
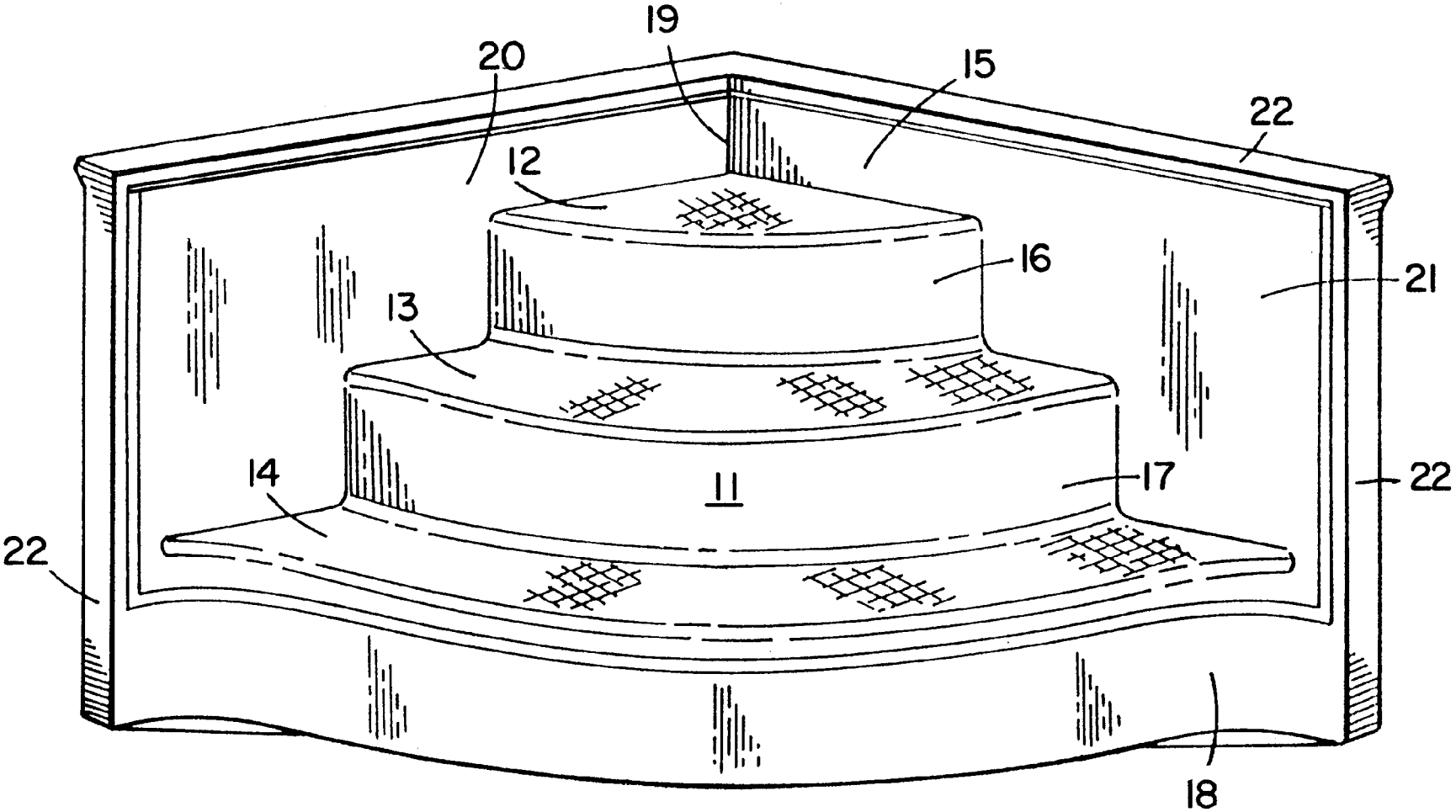
FIG. 1 is a front view of the present integral, molded corner wall and stair.

FIG. 1 shows the corner stair 11 having a required number of steps, for example, three steps 12, 13, and 14, with respective risers 15, 16, and 17, and a lower riser 18 that extends from the floor to the lower step 14. The riser 15 has a central right-angle corner 19 that determines the positions of right-angle wall portions 20 and 21 that upon connection to respective side wall and end wall panels of a pool under construction will replace two usual joined panels at the corner of the pool. The stair is molded from acrylic plastic and is approximately ½-inch (1.27-cm) thick with perpendicular upper and vertical flanges 22 of the wall portions being the same thickness and 4 inches (10.16 cm) wide to accommodate connection of a coping to the upper flanges and connection of an adjacent usual wall panels to respective, vertical ends of wall portions 20 and 21.

Figure 2:
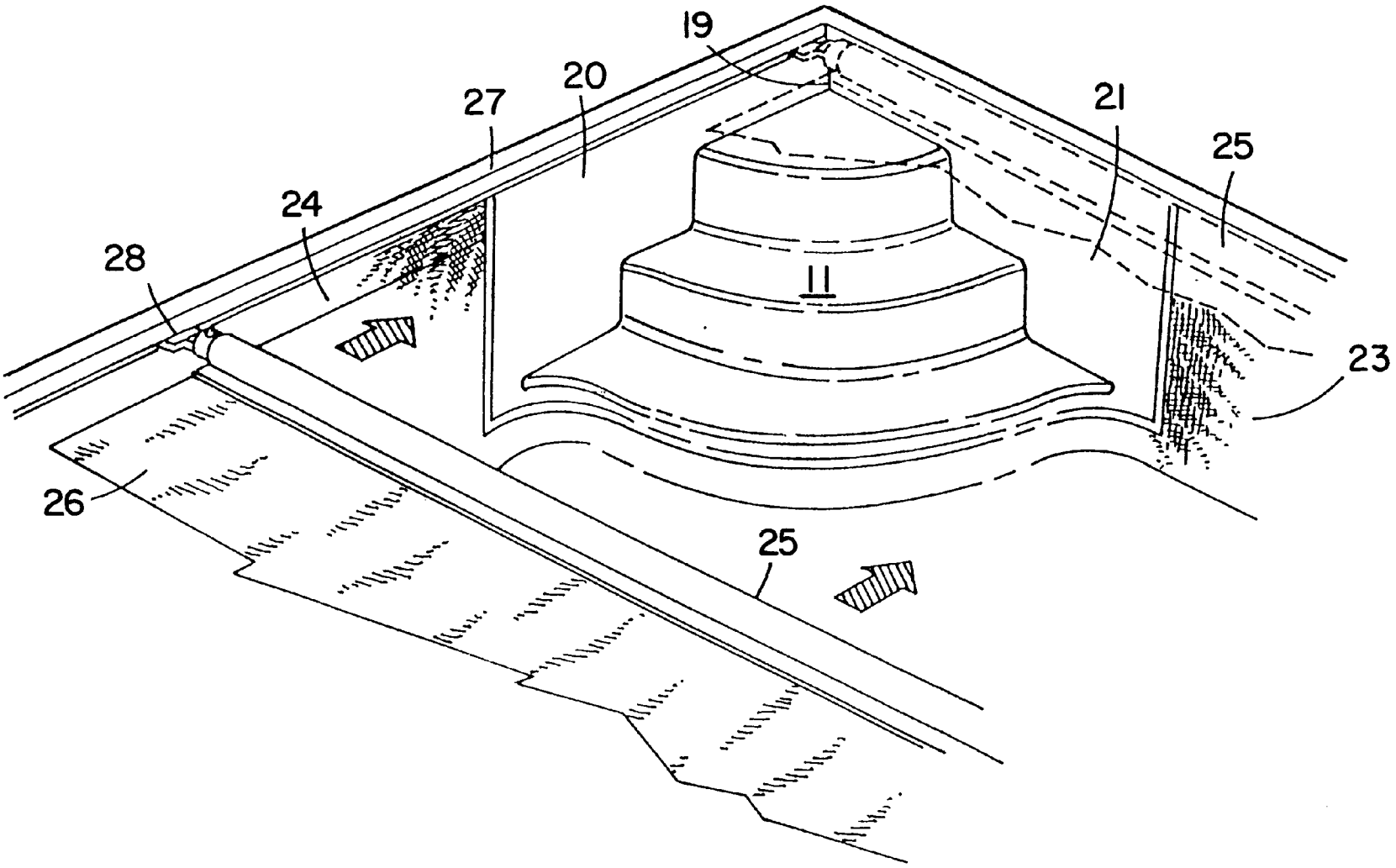
FIG. 2 is a fragmentary perspective view of a corner of a pool containing the present corner wall.

In FIG. 2, wall portions 20 and 21 of the stair 11 are connected to a usual side panel 24 and an end panel 23 respectively such that the corner 19 of the stair 11 is in line with the inner sides of the wall panels. The lead bar 25 of an automatic swimming pool cover is shown in a position where it is approaching the position shown in dashed lines against the end panel 23 for closing the cover 26 completely over the steps of the corner stair 11.

Figure 4:
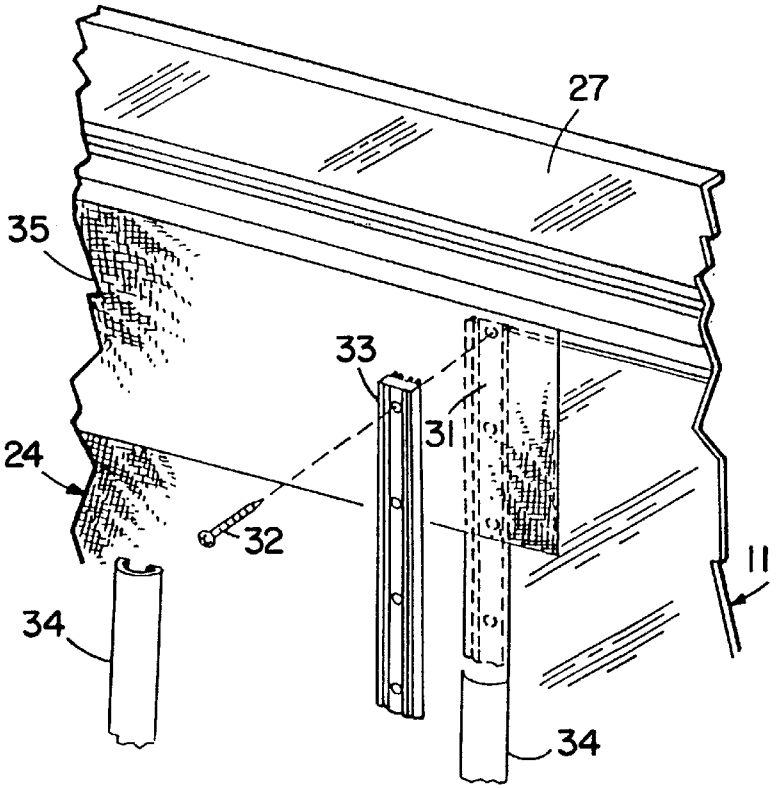
FIG. 4 is a perspective view of the inside end of the side panel and exploded view of parts for utilizing and edge of the swimming pool liner for sealing between the walls.
Figure 3:
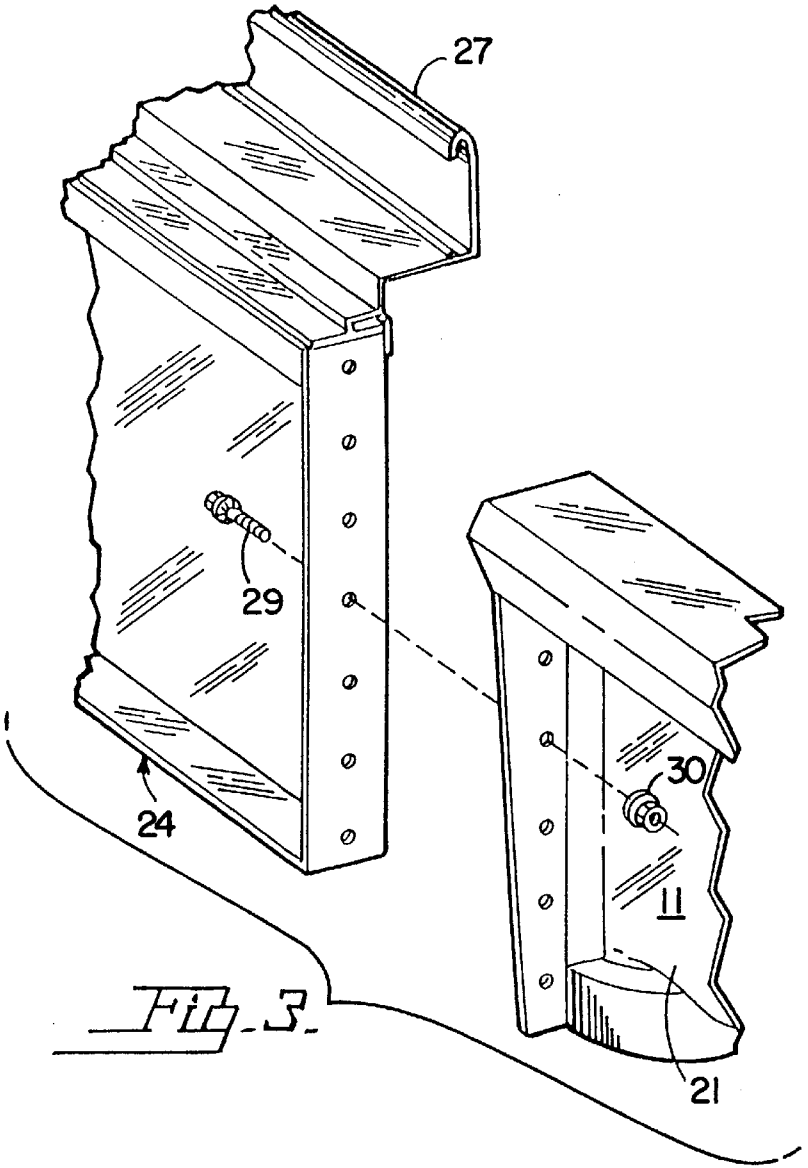
FIG. 3 is a perspective outside view of the outer end of a side panel of a pool and an adjoining portion of the wall of the corner stair to show means for connecting the corner stair to the usual side panel.

The FIGS. 3 and 4 illustrate a usual method for connecting the wall portions 20 and 21 to side wall 24 and 23 respectively before the coping 27 is bolted to the top flanges of the panels and the corner stair. As shown in the outer view of FIG. 3, the vertical flanges of the side wall 24 and the stair 11 are drilled to be joined by bolts 29 and nuts 30.

Brackets 28 (FIG. 2) connected to the respective ends of the lead bar 25 are connected to a cover track directly below that part of a cantilever base of the coping 27 that is bolted to the flanges at the tops of the respective side panels. The swimming pool liner has been cut to leave an opening such that the edges of the opening can be overlapped over the edges of the stair 11. After the wall of the stair 11 is bolted to the side walls, a strip of adhesive gasket 31 (FIG. 4) is pressed into a shallow groove along the vertical edge of the inner side of the stair 11, The adjoining edge of the swimming pool liner 35 is then pulled over the gasket 31 to be held tightly against the gasket 31 by a strip that is the face mount liner holder 33 connected by screws 32 turned through the gasket 31 into the wall portion of the stair 11. The liner holder 33 has curved outward vertical edges into which is snapped an elongated decorative cap 34.

I claim:

1. A rectangular swimming pool comprising: four sides comprised of prefabricated wall panels with upper edges, said pool having an automatic cover with a lead bar across said pool, each of said sides of said pool being constructed from said prefabricated wall panels and having a cover track extending horizontally along an inside surface of each of said sides of said pool adjacent the upper edges of said sides, said lead bar having a bracket at each end thereof engaging said cover track, one of said ends of said lead bar having an operating mechanism for moving said lead bar from an end of said pool between said sides to an opposite end of said pool for closely abutting the opposite end of said pool; and a prefabricated corner stair structure installed in said opposite end of said pool, having a vertical corner located at a center of a top step, a plurality of steps and respective risers extending downwardly and inwardly within said corner, said stair structure further comprising first and second upright wall portions extending from said corner at a right angle, one of said upright wall portions being in place of one of said wall panels in a corner portion of a selected one of said sides of said pool and the other of said upright wall portions being in place of one of said wall sections of said opposite end adjacent said selected one of said sides of said pool, an upper portion of each of said wall portions of said stair structure extending to said corner of said pool in alignment with said adjacent selected side such that said upper portions form a right-angle riser for an upper step of said stair structure, and said right-angle riser being of sufficient height for permitting said lead bar to clear said upper step for permitting said lead bar to be positioned closely against said opposite end wall, said corner stair structure is also the corner wall with said steps being entirely within extended lines of the adjacent walls of said swimming pool.

* * * * *